United States Patent [19]

Sukup

[11] Patent Number: 5,054,732

[45] Date of Patent: Oct. 8, 1991

[54] INTRAVENOUS FEEDER SUPPORT FOR STROLLER

[76] Inventor: Eldon R. Sukup, R.R. 2, Box 49T, Neola, Iowa 51559

[21] Appl. No.: 673,524

[22] Filed: Feb. 19, 1991

Related U.S. Application Data

[63] Continuation of Ser. No. 380,667, Jul. 17, 1989, abandoned.

[51] Int. Cl.[5] ..... A47F 5/00

[52] U.S. Cl. ..... 248/309.1; 224/42.46 R; 248/311.3

[58] Field of Search ..... 248/309.1, 311.2, 311.3, 248/125, 201; 224/42.46 R, 42.45 R; 280/304.1, 33.992, 650; 5/503

[56] References Cited

U.S. PATENT DOCUMENTS

| | | | |
|---|---|---|---|
| 2,470,524 | 5/1949 | Scudder | 280/304.1 X |
| 2,673,771 | 3/1954 | Krewson | 248/311.3 X |
| 2,935,286 | 5/1960 | Parsons | 248/311.3 |
| 3,178,199 | 4/1960 | Hamilton | 280/47.38 |
| 3,709,372 | 1/1973 | Alexander | 248/311.3 X |
| 3,709,556 | 1/1973 | Allard et al. | 248/125 X |
| 3,970,344 | 7/1976 | Baumann | 248/311.2 X |
| 4,005,844 | 2/1977 | Richmond | 248/311.3 |
| 4,262,872 | 4/1981 | Kodet | 248/311.3 |
| 4,346,912 | 8/1982 | Habib | 224/42.46 R X |
| 4,376,502 | 3/1983 | Cohen | 224/42.46 R X |
| 4,431,206 | 2/1984 | Pryor | 280/304.1 |
| 4,511,157 | 4/1985 | Wilt | 280/304.1 |
| 4,526,187 | 7/1985 | Ciullo | 248/311.3 X |
| 4,572,536 | 2/1986 | Doughty | 280/304.1 |
| 4,725,027 | 2/1988 | Bekanich | 248/311.3 X |
| 4,747,172 | 5/1988 | Hohol et al. | 248/201 X |

FOREIGN PATENT DOCUMENTS

| | | | |
|---|---|---|---|
| 0083971 | 8/1956 | Netherlands | 224/42.46 R |
| 2017606 | 10/1979 | United Kingdom | 224/42.46 R |

*Primary Examiner*—Ramon O. Ramirez
*Attorney, Agent, or Firm*—David L. Baker

[57] ABSTRACT

An intravenous feeder device removably attachable to a baby stroller facilitating the transporting of a baby requiring intravenous feeding. The bottle, or bag, containing the I.V. solution is supported by a vertical pole extending from an external vertical structural member of the stroller near the handle. Mounted between the handle support members a box-like structure carries the feeder regulator.

1 Claim, 1 Drawing Sheet

INTRAVENOUS FEEDER SUPPORT FOR STROLLER

This is a continuation of application Ser. No. 07/380,667, filed 07/17/89, now abandoned.

BACKGROUND OF THE INVENTION

1. Field of the Invention

A box-like attachment with adjustable mounting means for strollers, for carrying an intravenous feeding regulator with a vertical pole for supporting the infusion bottle, or bag.

2. Description of the Prior Art

U.S. Pat. No. 4,431,206 Pryor, discloses an accessory carrier, for carrying intravenous containers, attachable to a wheel chair. U.S. Pat. No. 2,470,524 Scudder, discloses an intravenous stand attachable to a wheel stretcher in fixed relation thereto in any movement of a stretcher borne patient.

SUMMARY OF THE INVENTION

The instant patent application relates to means for carrying an intravenous supply container and feeding regulator on a baby stroller. The wide variety of stroller designs requires a load-box with adjustable means for attaching the device to any stroller.

The load-box for carrying the feeding regulator is centrally mounted between the stroller handles by metal straps adjustable to fit between the handle members. The adjustment being facilitated by matching longitudinal slots in the metal straps confined by thumb screws fastening the straps together.

The metal straps affixed to the ends of the load-box extending terminating in clamping means attachable to the vertical tabular frame members of the stroller handle. Reinforcing metal straps extend from the horizontal portion of the stroller handle to the transverse portion of the load-box support straps. A clamping means attachable to the stroller vertical tubular frame member supporting a vertical pole. The type of vertical pole including a pair of horizontal arms for supporting an intravenous bottle.

In use the load box is centrally mounted between the handles of the stroller by means of the slots and screws in the metal straps. The vertical pole is clamped to a side vertical section of the stroller frame. An intravenous supply bottle is attached to the horizontal arm at the top of the pole, the delivery tube of the intravenous bottle is extended downwards to the feeding regulator in the load-box. A delivery tube from the feeding regulator is extended downward to attach to the baby.

DETAILED DESCRIPTION OF THE PREFERRED EMBODIMENTS

Figure 1:
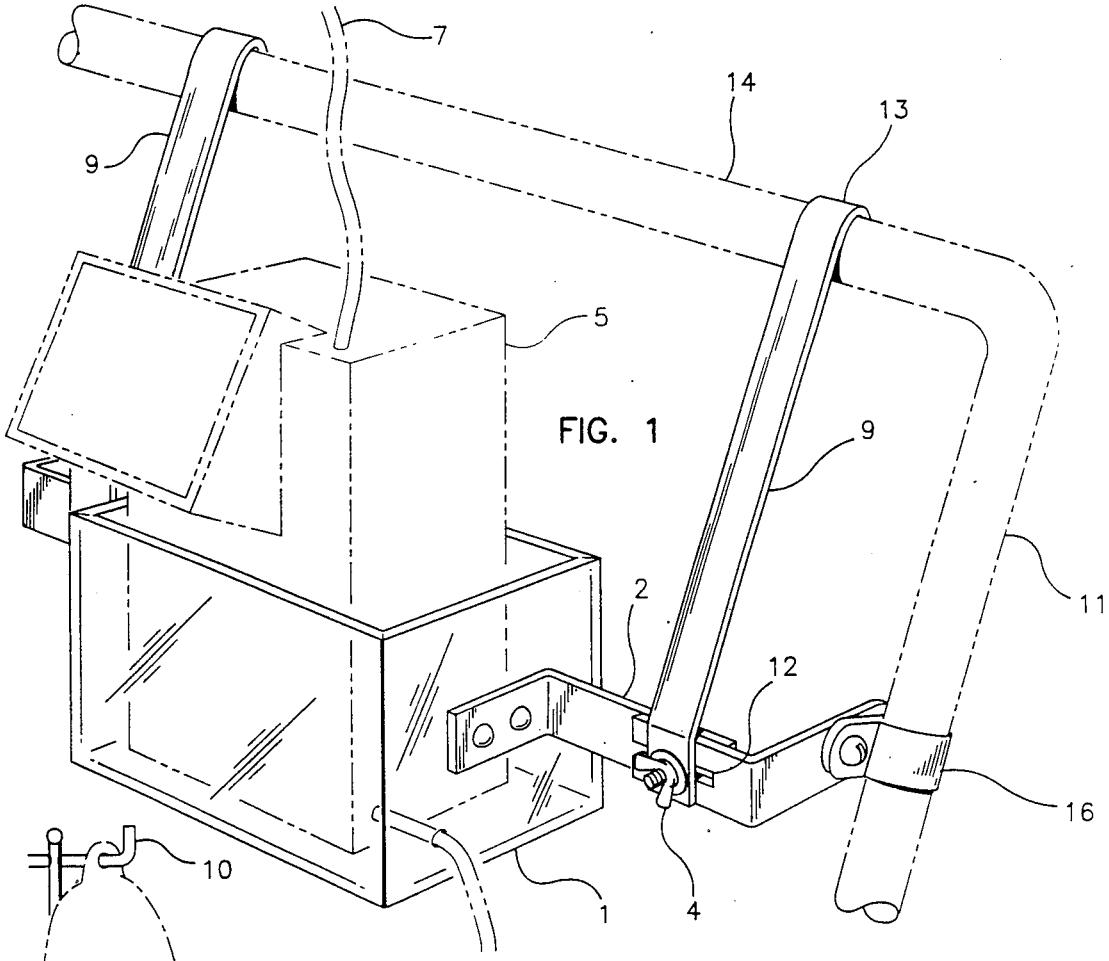
FIG. 1 is a top side perspective view of the intravenous feeder mounted on a stroller.

Referring to FIG. 1 the load-box 1 with attached brackets 2 is shown adjustably mounted to the transverse mounting brackets 3 by thumb screws 4 and longitudinal slots 12 and connecting reinforcing straps 9 The reinforcing straps 9 extending upwards to clamps 13 on the horizontal members 14 of the stroller handle. The mounting brackets 3 terminating in clamping means 16 mounted on stroller handle 11. The feeding regulator 5 with input tube 7 and exit tube is carried in the load-box 7.

Figure 2:
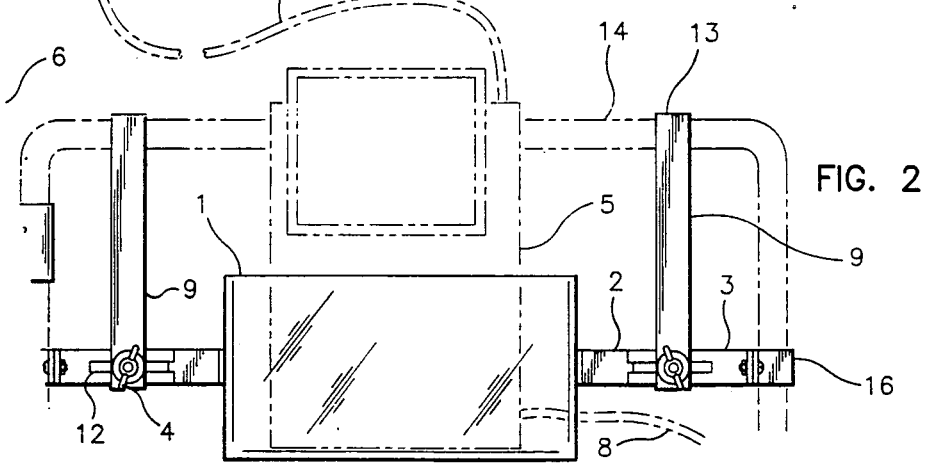
FIG. 2 is a front view of the intravenous feeder mounted on a stroller.

The front view of the intravenous feeder of FIG. 2 shows the vertical pole 6 attached to the stroller frame 11 by clamping means 15. The horizontal arm 10 of the top of the pole supporting the intravenous bottle, or bag 18. The exit tube 7 from the intravenous bottle 18 extending downwards to the feeder regulator 5 carried in the load-box. The exit tube 8 from the feeder regulator extending downwards for connection to the baby.

Attached on each end of the load-box brackets 2 having longitudinal slots 12 on the end portion are slidably attached to the mounting bracket 3 and the reinforcing straps 9 by the thumb screw 4. The reinforcing straps 9 extending upwards to attach to the stroller handle 14 by means of clamps 13.

Figure 3:
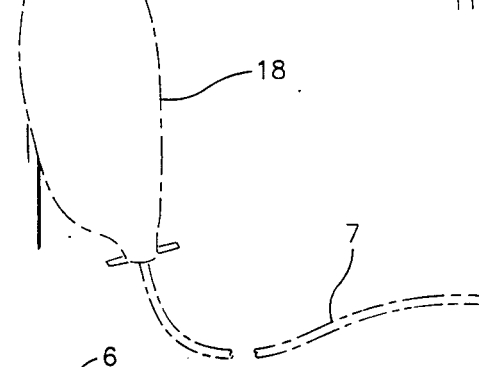
FIG. 3 is a detailed perspective view of the feeder mounting bracket.
Figure 3:
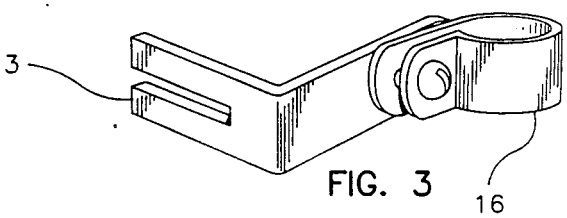

A detailed perspective view of the bracket 3 is shown in FIG. 3.

I claim:

1. A box-like carrier for an intravenous feeding regulator incorporating a vertical support for an I.V. bottle wherein the improvement comprises:

(a), means for mounting the box-like carrier horizontally between the handle of a stroller;

(b), means for mounting a vertical pole I.V. bottle support over the box-like carrier;

(c), the box-like carrier retainer having longitudinal metal straps extending from opposite sides, said straps having inward and outward ends;

(d), the outward ends of the straps having central longitudinal slots;

(e), metal brackets with matching longitudinal slots slidably attached at one end to the metal straps by a thumb screw extending through the longitudinal slots;

(f), the other ends of the brackets terminating in clamping means for attachment to a vertical portion of the stroller handle;

(g), a reinforcing strap fastened to the intersecting metal strap/bracket function extending upwards terminating in a clamping means on the horizontal portion of the stroller handle;

(h), a slidable clamp on a vertical structural member of the stroller handle accommodating a vertical pole extending upwardly;

(i), the vertical pole terminating in a horizontal arm; and, (j), means for suspending an I.V. feeder bottle from the horizontal arm.

* * * * *